US011590398B2

(12) United States Patent
Kodaira et al.

(10) Patent No.: US 11,590,398 B2
(45) Date of Patent: Feb. 28, 2023

(54) SWING ANALYSIS METHOD AND SWING ANALYSIS DEVICE

(71) Applicant: SEIKO EPSON CORPORATION, Tokyo (JP)

(72) Inventors: Kenya Kodaira, Azumino (JP); Kazuhiro Shibuya, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 102 days.

(21) Appl. No.: 16/830,394

(22) Filed: Mar. 26, 2020

(65) Prior Publication Data

US 2020/0306610 A1 Oct. 1, 2020

(30) Foreign Application Priority Data

Mar. 27, 2019 (JP) ..... JP2019-060194

(51) Int. Cl.

| | |
|---|---|
| ***A63B 69/36*** | (2006.01) |
| ***A63B 24/00*** | (2006.01) |
| ***A63B 71/06*** | (2006.01) |
| ***A63B 102/32*** | (2015.01) |

(52) U.S. Cl.

CPC ..... *A63B 69/3632* (2013.01); *A63B 24/0006* (2013.01); *A63B 71/0619* (2013.01); *A63B 2102/32* (2015.10); *A63B 2220/34* (2013.01); *A63B 2220/40* (2013.01); *A63B 2220/54* (2013.01); *A63B 2220/833* (2013.01)

(58) Field of Classification Search

CPC ..... A63B 69/3632; A63B 24/0006; A63B 71/0619; A63B 2102/32; A63B 2220/40; A63B 2220/34; A63B 2220/54; A63B 2220/833; A63B 2071/065; A63B 2225/50; A63B 24/0003; A63B 2220/803; A63B 2220/80; A63B 71/0622

See application file for complete search history.

(56) References Cited

U.S. PATENT DOCUMENTS

| | | | | |
|---|---|---|---|---|
| 2015/0142374 | A1 | 5/2015 | Shibuya | |
| 2015/0257682 | A1* | 9/2015 | Hansen | G16H 20/30 382/103 |
| 2020/0230482 | A1* | 7/2020 | Thornbrue | G01C 21/00 |

FOREIGN PATENT DOCUMENTS

| | | |
|---|---|---|
| JP | 2015-096105 A | 5/2015 |
| JP | 2017-029515 A | 2/2017 |

* cited by examiner

*Primary Examiner* — Jeffrey S Vanderveen
(74) *Attorney, Agent, or Firm* — Oliff PLC

(57) ABSTRACT

A swing analysis method includes acquiring measurement data measured by an inertial sensor in a swing motion with a golf club, and calculating torque data indicating a temporal change of a torque exerted on the golf club by analyzing the measurement data using a head speed coordination system having a first axis including a speed vector of a head of the golf club, a second axis being orthogonal to the first axis and extending along a shaft of the golf club, and a third axis orthogonal to both the first axis and the second axis.

7 Claims, 8 Drawing Sheets

SWING ANALYSIS METHOD AND SWING ANALYSIS DEVICE

The present application is based on, and claims priority from JP Application Serial Number 2019-060194, filed Mar. 27, 2019, the disclosure of which is hereby incorporated by reference herein in its entirety.

BACKGROUND

1. Technical Field

The present disclosure relates to a swing analysis method and a swing analysis device.

2. Related Art

In recent year, a swing analysis device that analysis swing motion with a golf club has been known. For example, JP-A-2015-96105 discloses a motion analysis device as a swing analysis device. With this, a swing analysis and analysis data indicating a state of a club posture can be grasped at a glance, and a swing motion state and quality inclination cab be determined accurately.

However, JP-A-2015-96105 discloses an analysis based on a club posture during a swing, but does not refer to control of a force being an important aspect for a swing motion.

SUMMARY

A swing analysis method according to the present application includes acquiring measurement data measured by an inertial sensor in a swing motion with a golf club, and calculating torque data indicating a temporal change of a torque exerted on the golf club by analyzing the measurement data using a head speed coordination system having a first axis including a speed vector of a head of the gold club, a second axis being orthogonal to the first axis and extending along a shaft of the golf club, and a third axis orthogonal to both the first axis and the second axis.

The swing analysis method described above may include determining a swing feature value of the swing motion, based on the torque data in a shorter period among a period from a top position to a natural release timing position and a period from the top position to a halfway down position in the swing motion.

In the swing analysis method described above, the torque data may include at least one of a force exerted for rotation about the first axis and a force exerted for rotation about the third axis.

In the swing analysis method described above, the torque data may be a force exerted for rotation about the third axis, the torque data in the shorter period may be divided at any dividing time point of the following including a middle time point in an elapsed time in the swing motion, a middle time point in a moving distance of the golf club, and a time point when a maximum value is recorded in the torque data, and the swing feature value may be a ratio of an integrated value of the torque in a first period before the dividing time point and an integrated value of the torque in a second period after the dividing time point.

In the swing analysis method described above, the torque data may be a force exerted for rotation about the first axis, and the swing feature value may be a matching degree with a swing plane.

A swing analysis device according to the present application includes an interface circuit configured to acquire measurement data measured by an inertial sensor in a swing motion with a golf club, and a processing unit configured to calculate torque data indicating a temporal change of a torque exerted on the golf club by analyzing the measurement data using a head speed coordination system having a first axis including a speed vector of a head of the golf club, a second axis being orthogonal to the first axis and extending along a shaft of the golf club, and a third axis orthogonal to both the first axis and the second axis.

DESCRIPTION OF EXEMPLARY EMBODIMENTS

Exemplary embodiments of the present disclosure will be described below with reference to the drawings. Note that the exemplary embodiment described hereinafter is not intended to unjustly limit the content of the present disclosure as set forth in the claims, and all of the configurations described in the exemplary embodiment are not always required to solve the issues described in the present disclosure.

1. Exemplary Embodiment

A swing analysis device and a swing analysis method according to the present exemplary embodiment will be described.

1.1 Configuration of Swing Analysis Device

Figure 1:
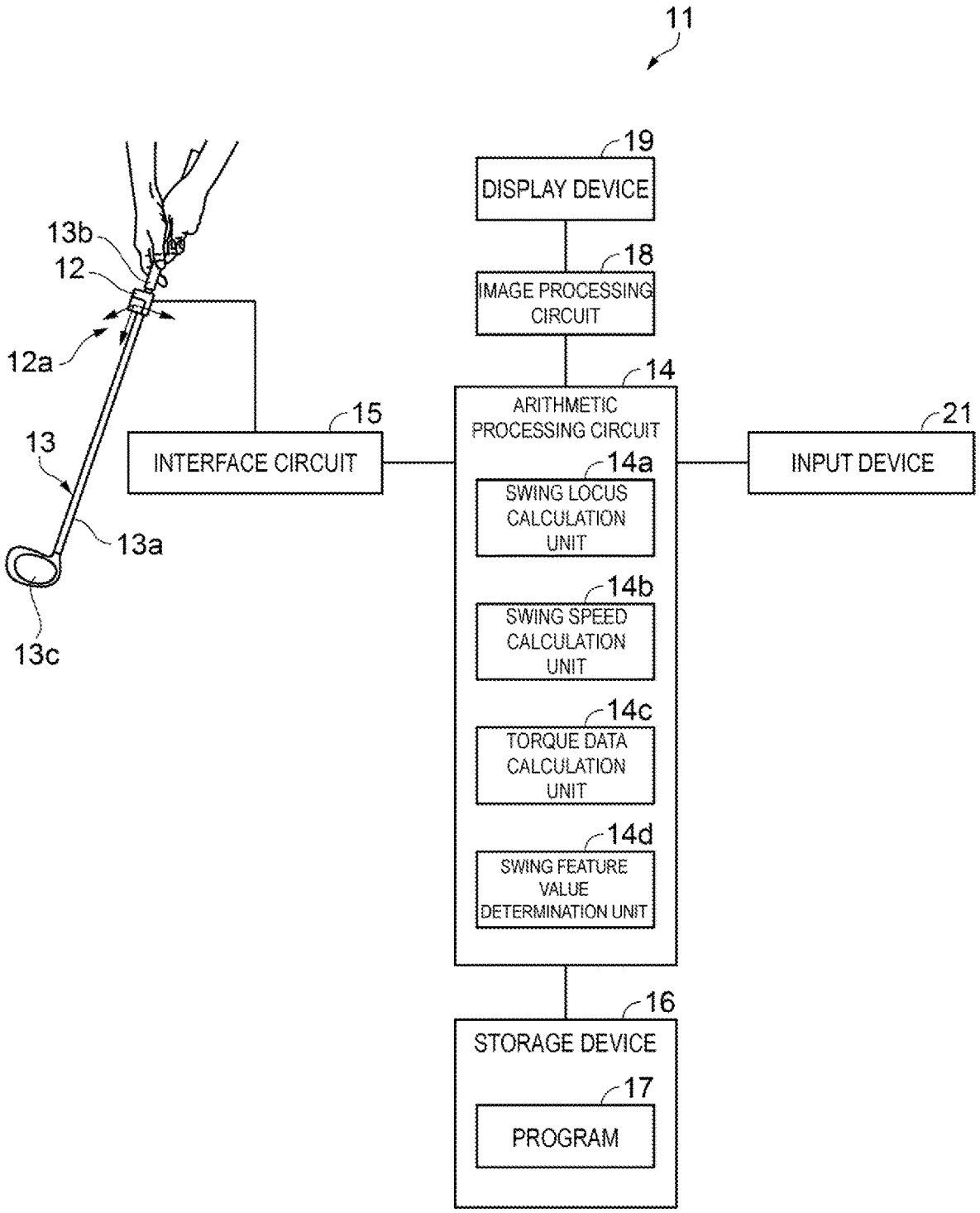
FIG. 1 is a diagram illustrating a configuration of a swing analysis device according to an exemplary embodiment.
Figure 2:
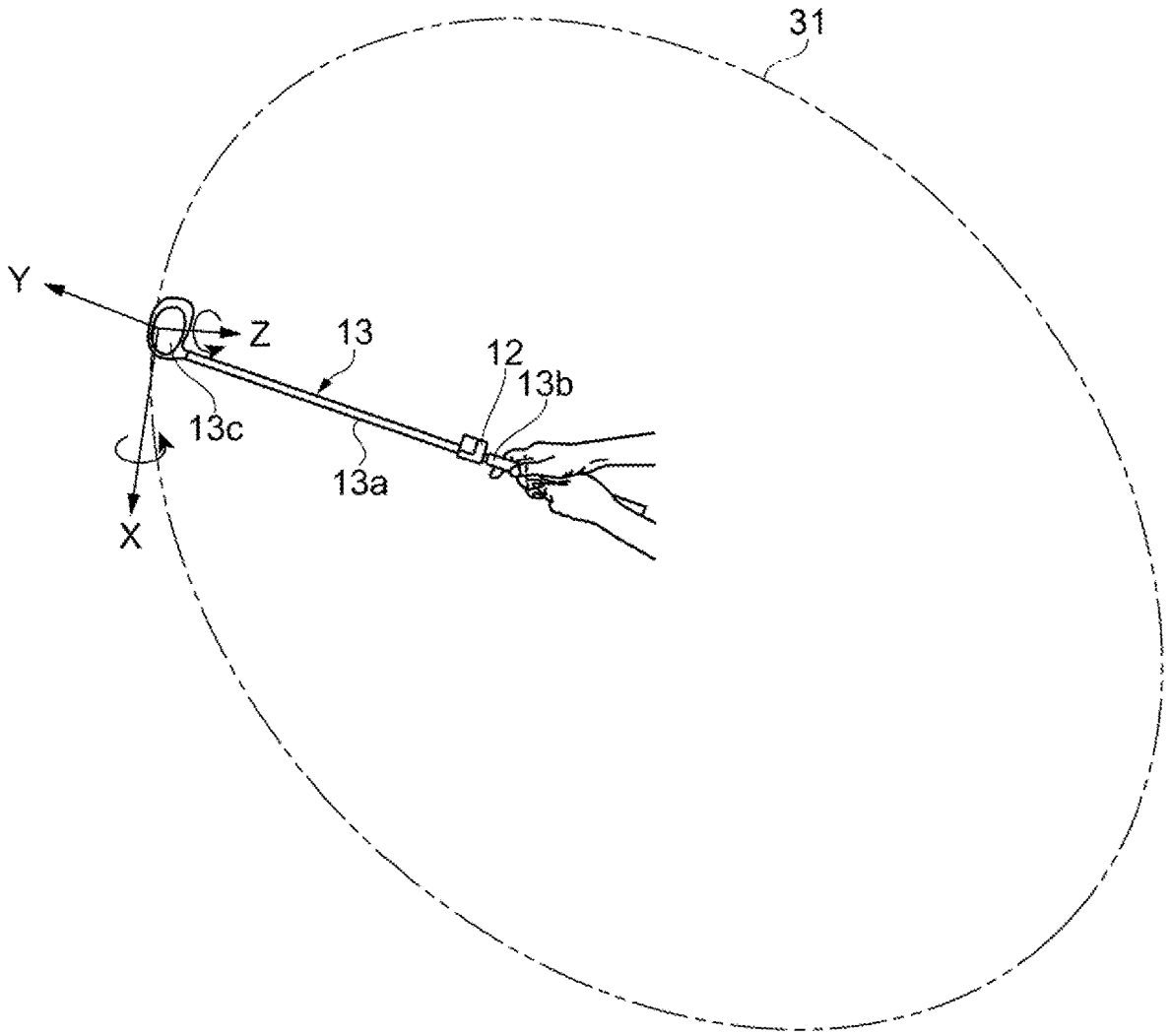
FIG. 2 is a diagram illustrating a head speed coordinate system.

First, a configuration of a swing analysis device will be described with reference to the drawings. FIG. 1 is a diagram illustrating a configuration of a swing analysis device according to an exemplary embodiment. FIG. 2 is a diagram illustrating a head speed coordinate system. A swing analysis device 11 includes an inertial sensor 12, an arithmetic processing circuit 14 as a processing unit, an interface circuit 15, a storage device 16, an image processing circuit 18, a display device 19, and an input device 21. The interface circuit 15, the storage device 16, the image processing circuit 18, and the input device 21 are electrically connected to the arithmetic processing circuit 14 via a bus (not shown).

For example, an acceleration sensor and a gyro sensor are incorporated in the inertial sensor 12. The acceleration sensor can measure acceleration individually in three axial directions orthogonal to one another. The gyro sensor can measure angular velocity individually about three axes orthogonal to one another. The inertial sensor 12 is attached to a shaft 13*a* of a golf club 13, and outputs measurement data measured during a swing motion with the golf club 13. The inertial sensor 12 obtains acceleration and angular velocity for each of three axes of a sensor coordinate system 12*a* set in the inertial sensor 12 in advance.

The arithmetic processing circuit 14 is connected to the inertial sensor 12. For this connection, the predetermined interface circuit 15 is connected to the arithmetic processing circuit 14. The interface circuit 15 inputs and outputs a signal between the inertial sensor 12 and the arithmetic processing circuit 14. The interface circuit 15 may be connected to the inertial sensor 12 with wiring, or may be connected to the inertial sensor 12 wirelessly. The measurement data is supplied from the inertial sensor 12 to the arithmetic processing circuit 14.

the arithmetic processing circuit 14 is connected to the storage device 16. The storage device 16 stores, for example, a golf swing analysis software program 17 and relevant data. The arithmetic processing circuit 14 executes the golf swing analysis software program 17 to perform a swing analysis. The storage device 16 includes a Dynamic Random Access Memory (DRAM), a large capacity storage device unit, a nonvolatile memory, and the like. For example, when a swing analysis method is performed, the DRAM temporarily stores the golf swing analysis software program 17. The large capacity storage device unit such as a hard disk drive stores the golf swing analysis software program 17 and data. The nonvolatile memory stores a program or data with a relatively small capacity such as Basic Input Output System (BIOS) (registered trademark).

The arithmetic processing circuit 14 acquires the measurement data output from the inertial sensor 12 via the interface circuit 15. The arithmetic processing circuit 14 includes a swing locus calculation unit 14*a*, a swing speed calculation unit 14*b*, a torque data calculation unit 14*c*, and a swing feature value determination unit 14*d*.

The swing locus calculation unit 14*a* executes the golf swing analysis software program 17, and calculates a swing locus along a time axis, based on the measurement data obtained by the inertial sensor 12. The swing locus indicates a temporal change of a position of each part of the golf club 13 while a test subject performs a swing. In addition to a head locus 31 of a head 13*c* illustrated in FIG. 2, examples of the swing locus include a locus of the shaft 13*a*, a locus of a grip 13*b*, and a shift locus of a test subject himself or herself.

The swing speed calculation unit 14*b* executes the golf swing analysis software program 17, and calculates a swing speed along the time axis, based on the measurement data obtained by the inertial sensor 12. Examples of the swing speed include a speed of the head 13*c* of the golf club 13 and a speed of the grip 13*b*.

The torque data calculation unit 14*c* executes the golf swing analysis software program 17, analyzes the measurement data obtained by the inertial sensor 12, and calculates torque data indicating a temporal change of a torque exerted on the golf club 13 for each of three axes of a head speed coordinate system. That is, the torque data calculation unit 14*c* converts the measurement data on each of the three axes of the sensor coordinate system 12*a*, which is input from the inertial sensor 12, into the three axes of the head speed coordinate system, and calculates a torque applied around each of the three axes.

The head speed coordinate system is formed of a first axis, a second axis, and a third axis. The first axis includes a speed vector of the head 13*c* of the golf club 13, which is obtained by the swing speed calculation unit 14*b*. The second axis is orthogonal to the first axis, and extends along the shaft 13*a* of the golf club 13. The third axis is orthogonal to both the first axis and the second axis. In other words, the first axis is a direction of a tangent line of the head locus 31 of the head 13*c*, which is obtained by the swing locus calculation unit 14*a*. In the head speed coordinate system in the present exemplary embodiment, the first axis is referred to as an X axis, the second axis is referred to as a Y axis, and the third axis is referred to as a Z axis. Note that the arrow around the X axis and the arrow around the Z axis illustrated in FIG. 2 each indicate an orientation of a torque applied around each axis, and the distal end sides of the arrows indicate positive sides.

The swing feature value determination unit 14*d* executes the golf swing analysis software program 17, and determines a swing feature value of a swing motion, based on the torque data calculated by the torque data calculation unit 14*c*.

The arithmetic processing circuit 14 is connected to the image processing circuit 18. The arithmetic processing circuit 14 transmits predetermined image data to the image processing circuit 18. The image processing circuit 18 is connected to the display device 19. For this connection, the image processing circuit 18 is connected to a predetermined interface circuit (not shown). The image processing circuit 18 transmits an image signal to the display device 19 in accordance with the image data to be input. An image specified by the image signal is displayed on a screen of the display device 19. A liquid crystal display or other flat panel displays are used for the display device 19. In this case, the arithmetic processing circuit 14, the storage device 16, and the image processing circuit 18 are provided as, for example, computer devices.

The arithmetic processing circuit 14 is connected to the input device 21. The input device 21 includes at least alphabet keys and numeric keys. Character information and numerical value information are input from the input device 21 to the arithmetic processing circuit 14. For example, the input device 21 may be formed of a key board. A combination of computer devices and a key board may be replaced with, for example, a smartphone, a mobile phone terminal, and a tablet personal computer (PC).

1.2 Swing Analysis Method

Figure 3:
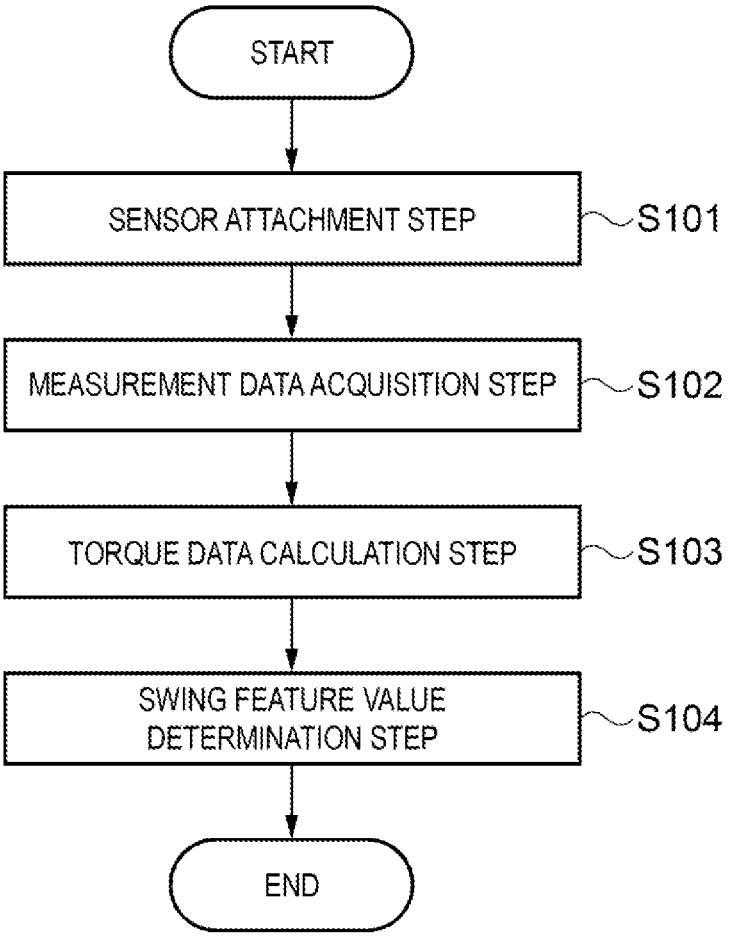
FIG. 3 is a flowchart diagram illustrating a swing analysis method.
Figure 4:
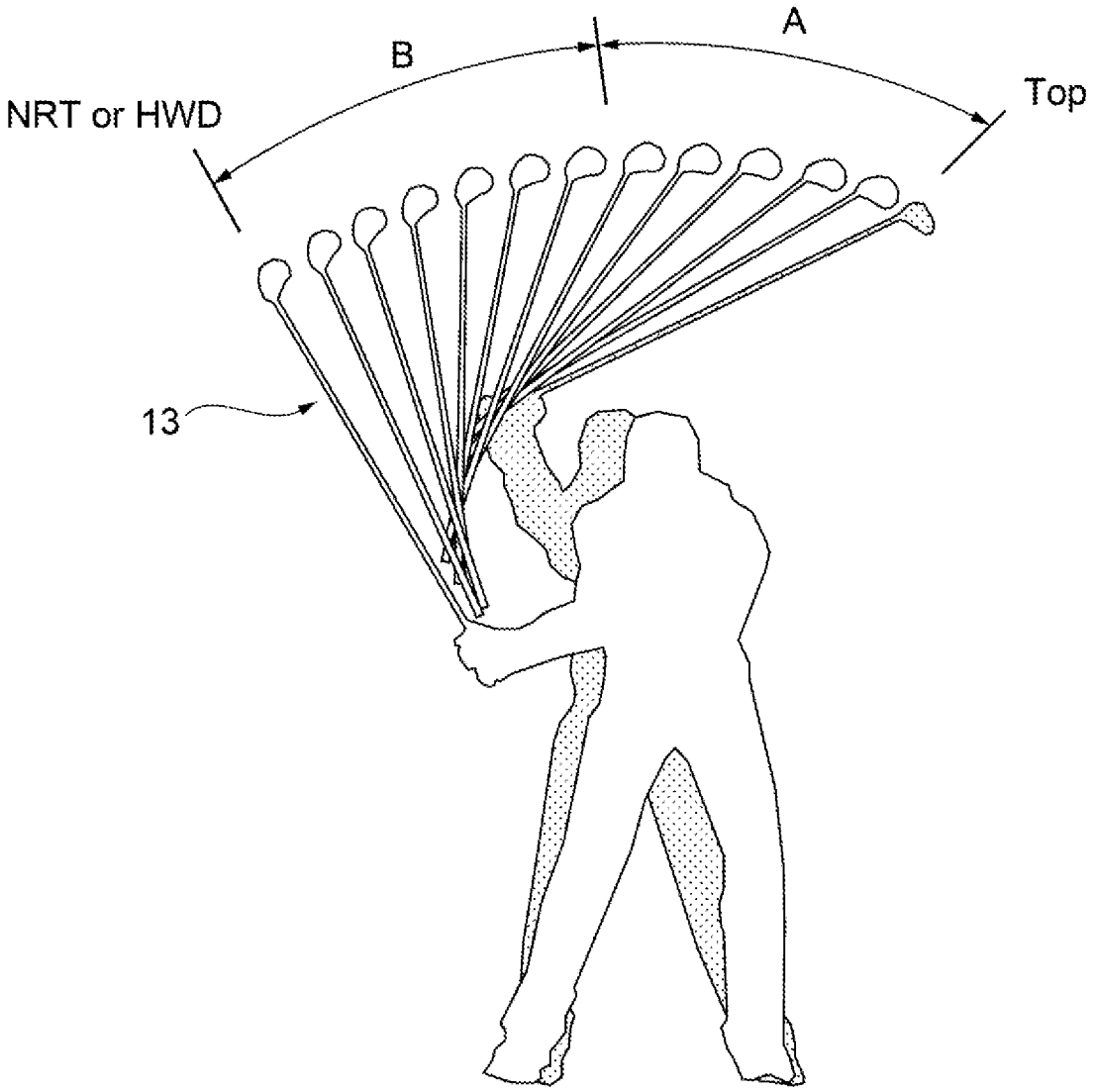
FIG. 4 is a diagram illustrating a swing analysis range.
Figure 5:
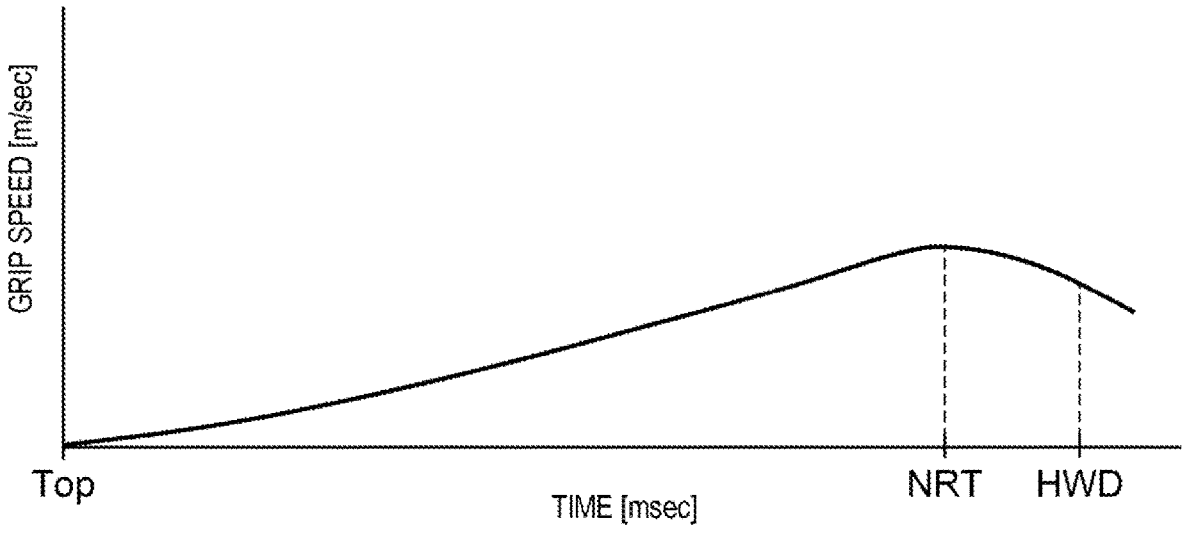
FIG. 5 is a diagram illustrating an example of a grip speed.
Figure 6:
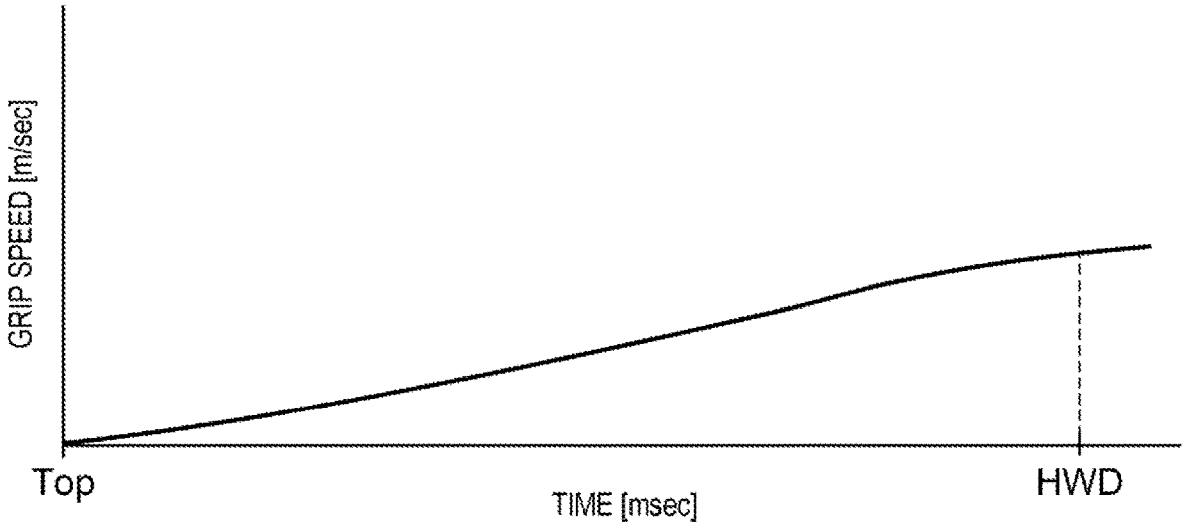
FIG. 6 is a diagram illustrating an example of a grip speed.
Figure 7:
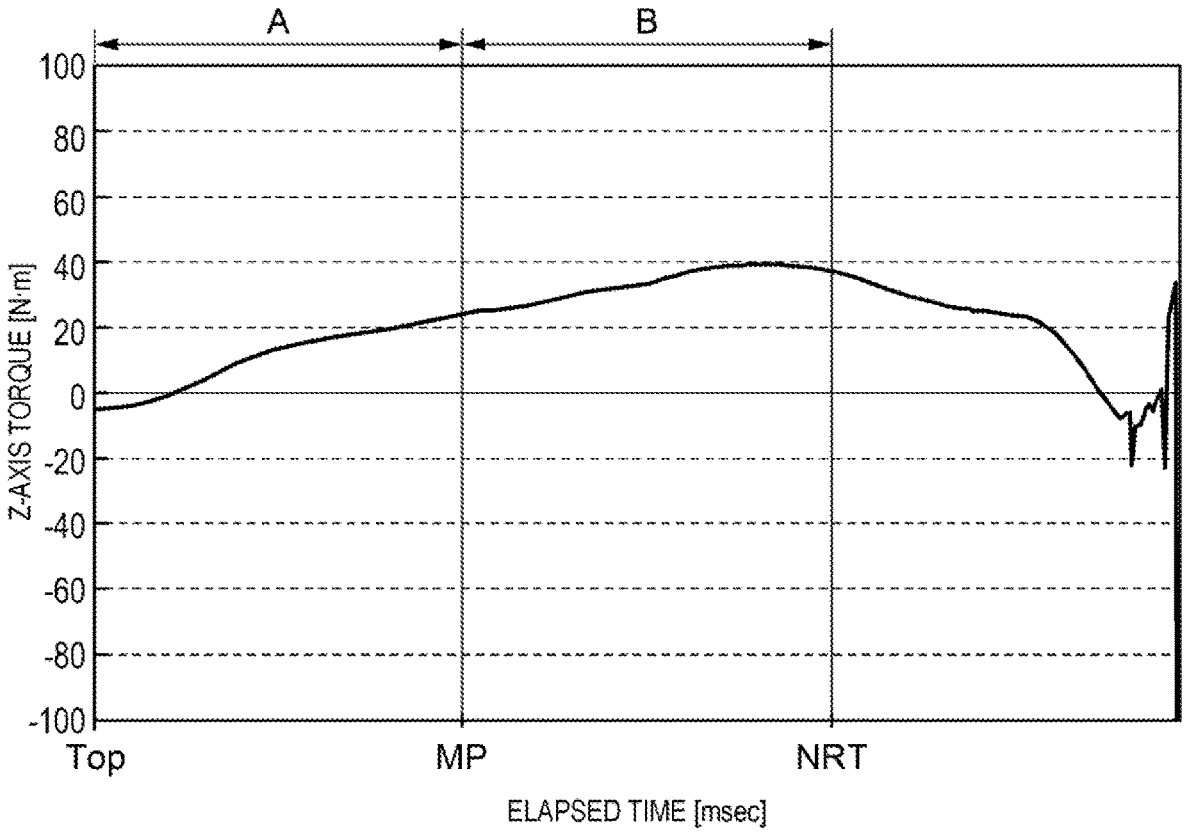
FIG. 7 is a diagram illustrating torque data exerted in a Z axis.
Figure 8:
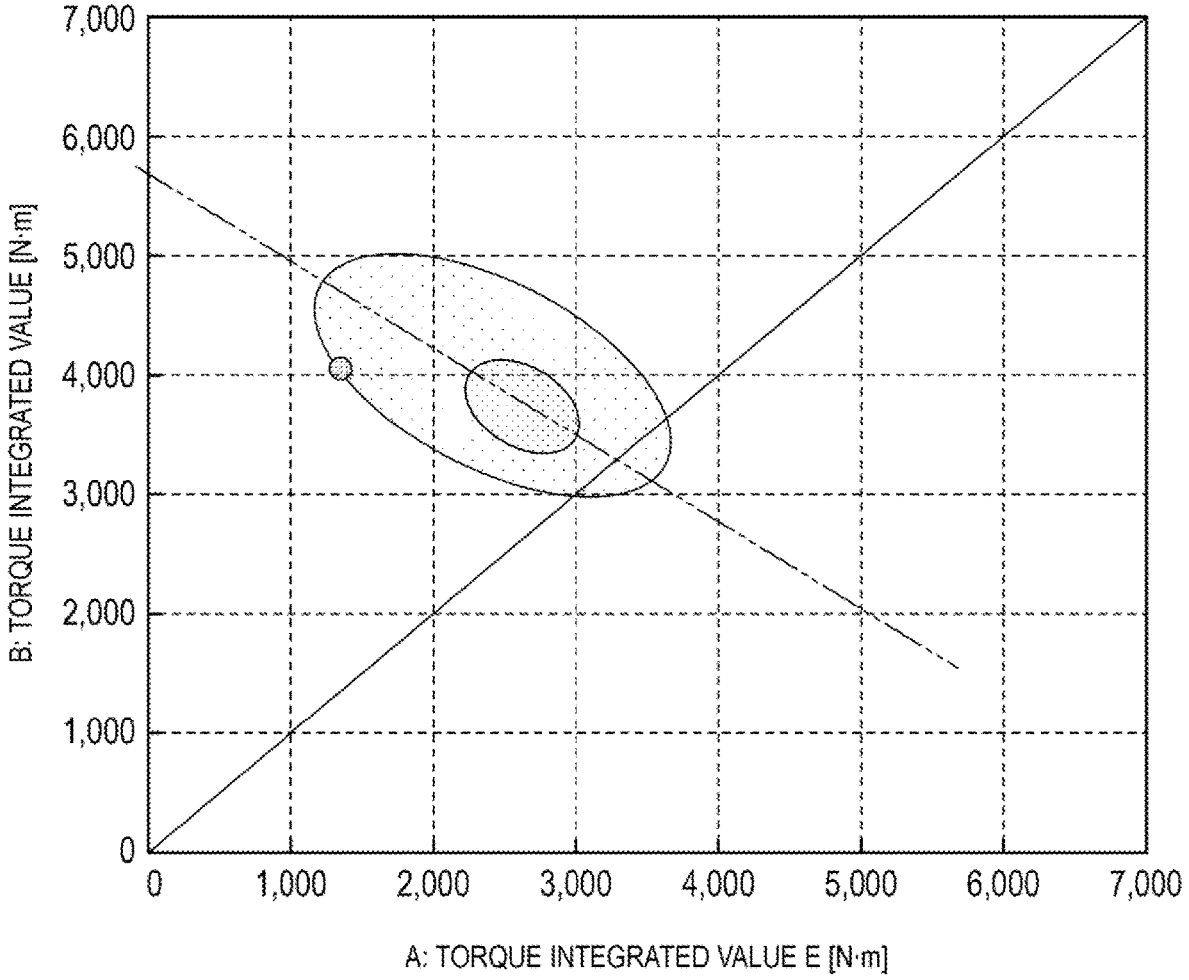
FIG. 8 is a diagram illustrating a distribution of torque data.

Next, a swing analysis method will be described with reference to the drawings. FIG. 3 is a flowchart diagram illustrating the swing analysis method. FIG. 4 is a diagram illustrating a swing analysis range. FIG. 5 and FIG. 6 are diagrams illustrating an example of a grip speed. FIG. 7 is a diagram illustrating torque data exerted in a Z axis. FIG. 8 is a diagram illustrating a distribution of torque data.

Step S101 is a sensor attachment step for attaching the inertial sensor 12. The inertial sensor 12 is attached to the golf club 13. The golf club 13 includes the shaft 13*a* and the grip 13*b*. The grip 13*b* is gripped by hands. The grip 13*b* is formed coaxially with a long axis in which the shaft 13*a* extends. The head 13*c* is coupled to the distal end of the shaft 13*a*. The inertial sensor 12 is attached to the shaft 13*a* or the grip 13*b* of the golf club 13. The inertial sensor 12 is only required to be fixed to the golf club 13 in a relatively unmovable manner. In this case, when the inertial sensor 12 is attached, one of the detection axes being the three axes of the sensor coordinate system 12*a* of the inertial sensor 12 matches with the axis of the shaft 13*a*. Another one of the detection axes of the inertial sensor 12 preferably matches with a direction horizontal with a face surface of the head 13*c*.

Step S102 is a measurement data acquisition step for acquiring the measurement data from the inertial sensor 12. A test subject performs a swing motion with the golf club 13 to which the inertial sensor 12 is attached. The inertial sensor 12 measures acceleration and angular velocity for each axis of the sensor coordinate system 12*a* every 1/1000 seconds, for example, and outputs the measurement data that is measured. The arithmetic processing circuit 14 acquires the measurement data, which is measured by the inertial sensor 12, via the interface circuit 15 during a swing motion with the golf club 13.

Step S103 is a torque data calculation step for calculating the torque data. The torque data calculation unit 14*c* uses the head speed coordinate system, and calculates the torque data indicating a temporal change of a torque exerted on the golf club 13, based on the measurement data obtained by the inertial sensor 12. The torque data calculation unit 14*c* calculates the torque data indicating a force exerted for rotation about the X axis and the torque data indicating a force exerted for rotation about the Z axis.

Step S104 is a swing feature value determination step for determining a feature value of a swing motion, based on the torque data. The swing feature value determination unit 14*d* determines a swing feature amount, based on the torque data in a shorter period among a period from a top position Top to a natural release timing position NRT and a period from the top position Top to a halfway down position HWD in a swing motion.

As illustrated in FIG. 4, the swing feature value determination unit 14*d* regards any one of the period from the top position Top to the natural release timing position NRT and the period from the top position Top to the halfway down position HWD as a swing analysis period. Next, the top position Top, the natural release timing position NRT, the halfway down position HWD, and the swing analysis period will be described.

FIG. 5 and FIG. 6 illustrate a speed of the grip 13*b* of the golf club 13. The vertical axis indicates a grip speed, and the horizontal axis indicates an elapsed time in a swing motion. At the top position Top, the speed of the head 13*c* of the golf club 13 has a minimum value after a swing motion is started. An elapsed time required for arriving at the top position Top is obtained by a speed of the head 13*c* calculated by the swing speed calculation unit 14*b*. At the halfway down position HWD, the shaft 13*a* of the golf club 13 takes a horizontal posture in a downswing motion from the top position Top. An elapsed time required for arriving at the halfway down position HWD is obtained by a locus of the shaft 13*a* calculated by the swing locus calculation unit 14*a*.

At the natural release timing position NRT, the speed of the grip 13*b* is changed from acceleration to deceleration, in other words, the speed of the grip 13*b* is highest in a downswing motion from the top position Top. An elapsed time required for arriving at the natural release timing position NRT is obtained by a speed of the grip 13*b* calculated by the swing speed calculation unit 14*b*.

As illustrated in FIG. 5, when the natural release timing position NRT is measured between the top position Top and the halfway down position HWD, the swing feature value determination unit 14*d* regards the period from the top position Top to the natural release timing position NRT as the swing analysis period. Note that, depending on a swing motion performed by a test subject, the natural release timing position NRT may not be measured between the top position Top and the halfway down position HWD in some cases, as illustrated in FIG. 6. In this case, the swing feature value determination unit 14*d* regards the period from the top position Top to the halfway down position HWD as the swing analysis period.

Figure 9:
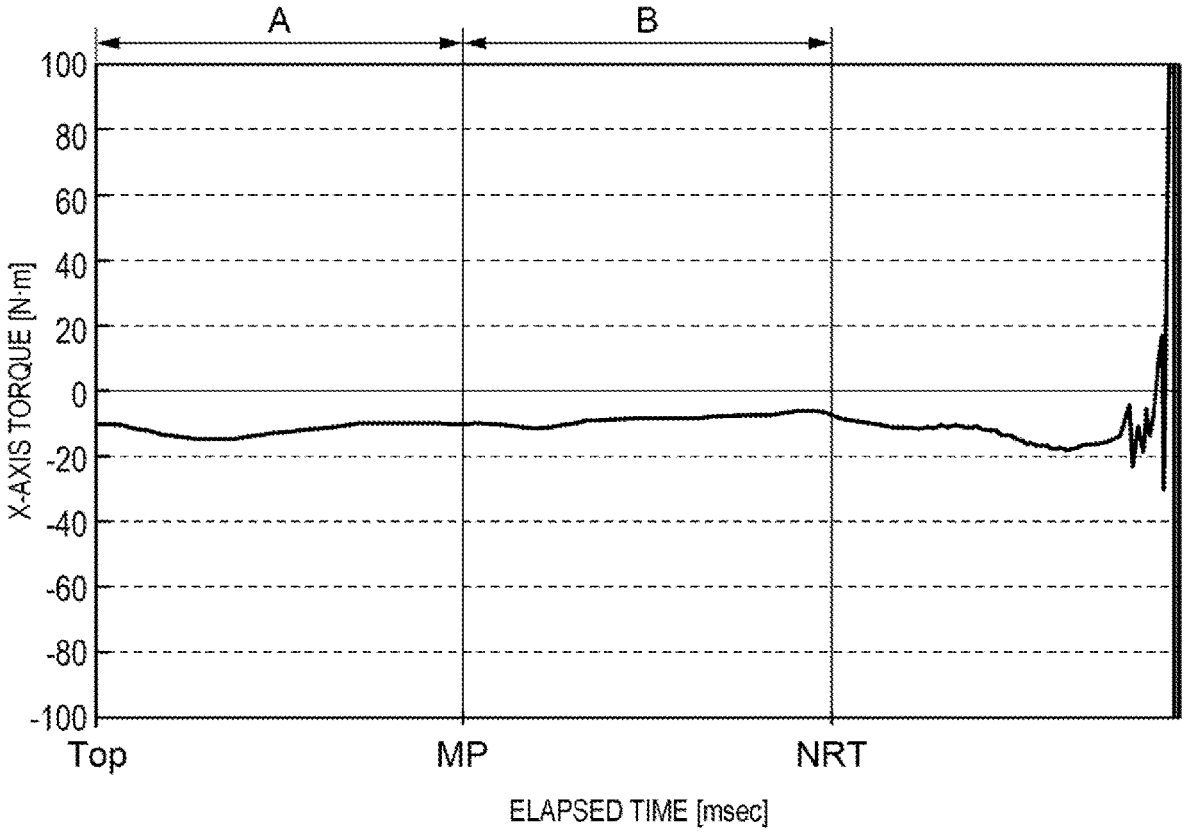
FIG. 9 is a diagram illustrating torque data about an X axis.

FIG. 7 is a diagram illustrating torque data exerted in the Z axis. FIG. 8 is a diagram illustrating a distribution of a torque integrated value ratio. FIG. 9 is a diagram illustrating torque data about the X axis. A swing feature amount determined by the swing feature value determination unit 14*d* will be described. In the following description, the torque data in the period from the top position Top to the natural release timing position NRT will be described.

The torque data illustrated in FIG. 7 is a force exerted for rotation about the Z axis. The vertical axis indicates a torque applied around the Z axis, and the horizontal axis indicates an elapsed time from the top position in a swing motion. The torque being a force exerted around the Z axis has a correlation with a peed in the X axis, that is, the speed of the head 13*c* of the golf club 13.

As illustrated in FIG. 7, the swing feature value determination unit 14*d* calculates the torque, which is applied around the Z axis by a swing motion with a test subject. The swing feature value determination unit 14*d* divides the torque data at an middle time point MP in the period from the top position Top to the natural release timing position NRT in the elapsed time of the swing, and sets a first period before the dividing middle time point MP, which is from the top position Top to the middle time point MP, as a first half turning region A and a second period after the dividing middle time point MP, which is from the middle time point MP to the natural release timing position NRT, as a second half turning region B. Hereinafter, the first half turning region A is also referred to as a first half region A, and the second half turning region B is also referred to as a second half region B. The swing feature value determination unit 14*d* obtains an integrated value of the torque applied around the Z axis in each of the first half region A and the second half region B, and calculates a ratio of a torque integrated value, which is applied in the second half region B, with respect to a torque integrated value, which is exerted in the first half region A. The ratio of those torque integrated values is referred to as a torque ratio.

FIG. 8 illustrates a distribution of the torque ratio. The vertical axis indicates a torque integrated value in the second half region B, and the horizontal axis indicates a torque integrated value in the first half region A. The outer oval illustrated in FIG. 8 indicates a distribution region of data accumulated in the past, and the inner oval indicates a concentration region of the data. A torque ratio at the center point thereof is approximately 1.38. The two-dot chain line in FIG. 8 is a long axis of the oval, and indicates a direction in which the torque ratio is distributed. A torque ratio of a test subject in the torque data around the Z axis illustrated in FIG. 7 is approximately 3.03. From this, it can be understood that the swing has a feature of having an extremely large torque in the second half region B. In this manner, the swing feature value determination unit 14*d* indicates a swing feature value of a test subject with a torque ratio. Note that, in the present exemplary embodiment, description is made on a case where the torque data from the top position Top to the natural release timing position NRT is divided by the middle time point MP in the elapsed time of the swing. However, the middle time point may be a middle time point in a moving distance of the golf club 13 or a time point when a maximum value is recorded in the torque data.

The torque data illustrated in FIG. 9 is a force exerted for rotation about the X axis. The vertical axis indicates a torque applied around the X axis, and the horizontal axis indicates an elapsed time from the top position in a swing motion. The torque being a force exerted about the X axis has a correlation with a swing plane being a swing locus of the golf club 13. The swing plane is obtained by swinging the golf club 13, and is drawn on a line obtained by connecting an end of the grip 13*b* of the golf club 13 at the top position Top and a ball. When an ideal swing plane can be drawn, a force is transmitted to the head 13*c* efficiently, and an orientation of the face is stable. Thus, a swing achieves a flying distance of a shot ball that extends and is not bent. A wing without generating a torque around the X axis has a stable swing locus, and causes a state in which a force is sufficiently applied in a motion direction of the head 13*c*, which can be said as an ideal swing plane.

In FIG. 9, as the torque generated about the X axis in the period from the top position Top to the natural release timing position NRT is closer to 0N·m, the swing plane can be said as an ideal one. The swing feature value determination unit 14*d* integrates the torque data around the X axis, and sets the resultant as a swing feature value of a test subject. The integrated value of the torque data can be an index of a deviation amount from 0N·m, that is, a matching degree with the ideal swing plane. Note that, in the present exemplary embodiment, description is made on a case where the torque data calculation unit 14*c* calculates the torque data indicating a force exerted for rotation about the X axis and the torque data indicating a force exerted for rotation about the Z axis. However, the torque data calculation unit 14*c* may calculate torque data indicating a force exerted for rotation about at least any one of the X axis and the Z axis.

As described above, with the swing analysis method and the swing analysis device 11 according to the present exemplary embodiment, the effects below can be achieved.

The swing analysis method includes the torque data calculation step in which the torque data calculation unit 14*c* uses the head speed coordinate system, and calculates the torque data indicating a temporal change of a torque exerted on the golf club 13, based on the measurement data measured by the inertial sensor 12. With this, the swing analysis method, which can analyze a feature of force control of a test subject in a swing motion, can be provided.

In the swing feature value determination step, the swing feature value determination unit 14*d* determines a swing feature value in a swing motion from the top position Top to the natural release timing position NRT or from the top position Top to the halfway down position HWD. With this, a feature of force control of a test subject in a swing motion can be analyzed.

In the torque data calculation step, the torque data calculation unit 14*c* calculates at least one of the torque data indicating a force exerted for rotation about the X axis and the torque data indicating a force exerted for rotation about the Z axis. With this, force control of at least one of a force exerted for rotation about the first axis of a test subject in a swing motion and a force exerted for rotation about the third axis can be analyzed.

In the swing feature value determination step, the swing feature value determination unit 14*d* calculates a torque ratio of the first half region A and the second half region B. based on the torque data around the Z axis. With this, a feature of force control of a test subject in a swing motion can be analyzed from the torque ratio.

In the swing feature value determination step, the swing feature value determination unit 14*d* integrates the torque data around the X axis, and sets the resultant as a swing feature amount of a test subject. With this, a matching degree with the ideal swing plane can be analyzed.

The swing analysis device 11 includes the torque data calculation unit 14*c* that uses the head speed coordinate system, and calculates the torque data indicating a temporal change of a torque exerted on the golf club 13, based on the measurement data measured by the inertial sensor 12. With this, the swing analysis device 11, which can analyze a feature of force control of a test subject in a swing motion, can be provided.

Contents derived from the exemplary embodiments will be described below.

The swing analysis method includes acquiring measurement data measured by an inertial sensor in a swing motion with a golf club, and calculating torque data indicating a temporal change of a torque exerted on the golf club by analyzing the measurement data using a head speed coordination system having a first axis including a speed vector of a head of the golf club, a second axis being orthogonal to the first axis and extending along a shaft of the golf club, and a third axis orthogonal to both the first axis and the second axis.

With this method, the torque data indicating a temporal change of a torque exerted on a golf club is calculated in the head speed coordinate system. Thus, the swing analysis method, which can analyze a feature of force control of a test subject in a swing motion, can be provided.

The swing analysis method described above may include determining a swing feature value of the swing motion, based on the torque data in a shorter period among a period from a top position to a natural release timing position and a period from the top position to a halfway down position in the swing motion.

With this method, a swing feature value in a swing motion from the top position to the natural release timing position or from the top position to the halfway down position is determined. Thus, a feature of force control of a test subject in a swing motion can be analyzed.

In the swing analysis method described above, the torque data may include at least one of a force exerted for rotation about the first axis and a force exerted for rotation about the third axis.

With this method, force control of at least one of a force exerted for rotation about the first axis of a test subject in a swing motion and a force exerted for rotation about the third axis can be analyzed.

In the swing analysis method described above, the torque data may be a force exerted for rotation about the third axis, the torque data in the shorter period may be divided at any dividing time point of the following including a middle time point in an elapsed time in the swing motion, a middle time point in a moving distance of the golf club, and a time point when a maximum value is recorded in the torque data, and the swing feature value may be a ratio of an integrated value of the torque in a first period before the dividing time point and an integrated value of the torque in a second period after the dividing time point.

With this method, the ratio of the torque integrated value of the first period and the torque integrated value of the second period is calculated based on the torque data around the third axis. Thus, a feature of force control of a test subject in a swing motion can be analyzed from the ratio of the torque integrated values.

In the swing analysis method described above, the torque data may be a force exerted for rotation about the first axis, and the swing feature value may be a matching degree with a swing plane.

With this method, the matching degree with the swing plane is calculated based on the torque data around the first axis. Thus, the matching degree with the swing plane can be analyzed.

A swing analysis device includes an interface circuit configured to acquire measurement data measured by an inertial sensor in a swing motion with a golf club, and a processing unit configured to calculate torque data indicating a temporal change of a torque exerted on the golf club by analyzing the measurement data using a head speed coordination system having a first axis including a speed vector of a head of the golf club, a second axis being orthogonal to the first axis and extending along a shaft of the golf club, and a third axis orthogonal to both the first axis and the second axis.

This configuration includes the processing unit configured to calculate the torque data indicating a temporal change of a torque exerted on a golf club in the head speed coordinate system. Thus, the swing analysis device, which can analyze a feature of force control of a test subject in a swing motion, can be provided.

What is claimed is:

1. A swing analysis method comprising:

providing an inertial sensor comprising an acceleration sensor and a gyro sensor, the inertial sensor being attached to a golf club, wherein the acceleration sensor is configured to measure acceleration individually in three axial directions orthogonal to one another, the three axial directions being constituted by a first axial direction along a first axis, a second axial direction along a second axis, and a third axial direction along a third axis, the gyro sensor is configured to measure angular velocity individually about the first, second and third axes orthogonal to one another, and the inertial sensor is configured to communicate wirelessly with an arithmetic processing circuit;

wirelessly acquiring, by the arithmetic processing circuit, measurement data that is measured by the inertial sensor in a swing motion with the golf club, wherein the measurement data comprises the acceleration measured by the acceleration sensor and the angular velocity measured by the gyro sensor; and calculating, by the arithmetic processing circuit, torque data indicating a temporal change of a torque exerted on the golf club by analyzing the measurement data using a head speed coordination system having the first axis including a speed vector of a head of the golf club, the second axis being orthogonal to the first axis and extending along a shaft of the golf club, and the third axis being orthogonal to both the first axis and the second axis;

determining, by the arithmetic processing circuit, a swing feature value of the swing motion, based on the torque data in a shorter period among a period from a top position to a natural release timing position in the swing motion and a period from the top position to a halfway down position in the swing motion, wherein the torque data is a force exerted for rotation about the third axis, and when the torque data in the shorter period is divided at a dividing time point of a plurality of time points including:

a middle time point in an elapsed time in the swing motion;

a middle time point in a moving distance of the golf club; and a time point when a maximum value is recorded in the torque data, the swing feature value is a ratio of an integrated value of the torque in a first period before the dividing time point and an integrated value of the torque in a second period after the dividing time point; and performing, by the arithmetic processing circuit, swing analysis, based on the determined swing feature value.

2. The swing analysis method according to claim 1, wherein the torque data includes at least one of a force exerted for rotation about the first axis and a force exerted for rotation about the third axis.

3. The swing analysis method according to claim 1, wherein the torque data is a force exerted for rotation about the first axis, and the swing feature value is a degree of matching with an ideal swing plane.

4. A swing analysis device comprising:

an inertial sensor that is attached to a golf club, the inertial sensor comprising an acceleration sensor and a gyro sensor, wherein the acceleration sensor is configured to measure acceleration individually in three axial directions orthogonal to one another, the three axial directions being constituted by a first axial direction along a first axis, a second axial direction along a second axis, and a third axial direction along a third axis, and the gyro sensor is configured to measure angular velocity individually about the three axes orthogonal to one another; and an arithmetic processing circuit, the inertial sensor being configured to communicate wirelessly with the arithmetic processing circuit, and the arithmetic processing circuit being configured to:

wirelessly acquire measurement data measured by the inertial sensor in a swing motion with the golf club, wherein the measurement data comprises the acceleration measured by the acceleration sensor and the angular velocity measured by the gyro sensor;

calculate torque data indicating a temporal change of a torque exerted on the golf club by analyzing the measurement data using a head speed coordination system having the first axis including a speed vector of a head of the golf club, the second axis being orthogonal to the first axis and extending along a shaft of the golf club, and the third axis being orthogonal to both the first axis and the second axis;

determine a swing feature value of the swing motion, based on the torque data in a shorter period among a period from a top position to a natural release timing position in the swing motion and a period from the top position to a halfway down position in the swing motion, wherein the torque data is a force exerted for rotation about the third axis, and when the torque data in the shorter period is divided at a dividing time point of a plurality of time points including a middle time point in an elapsed time in the swing motion;

a middle time point in a moving distance of the golf club; and a time point when a maximum value is recorded in the torque data, the swing feature value is a ratio of an integrated value of the torque in a first period before the dividing time point and an integrated value of the torque in a second period after the dividing time point; and perform swing analysis, based on the determined swing feature value.

5. The swing analysis device according to claim 4, wherein the torque data includes at least one of a force exerted for rotation about the first axis and a force exerted for rotation about the third axis.

6. The swing analysis device according to claim 5, comprising:

a display device configured to display the torque data.

7. The swing analysis device according to claim 4, comprising:

a display device configured to display the torque data.

* * * * *